US005610352A

United States Patent [19]

Yamaguchi

[11] Patent Number: 5,610,352

[45] Date of Patent: Mar. 11, 1997

[54] MECHANISM FOR ROTATABLY SUPPORTING ROTARY MEMBER OF KEYBOARD

[75] Inventor: Tsutomu Yamaguchi, Hamamatsu, Japan

[73] Assignee: Kabushiki Kaisha Kawai Gakki Seisakusho, Hamamatsu, Japan

[21] Appl. No.: 348,227

[22] Filed: Nov. 28, 1994

[30] Foreign Application Priority Data

Nov. 30, 1993 [JP] Japan ..... 5-064094 U
Nov. 30, 1993 [JP] Japan ..... 5-064096 U

[51] Int. Cl.[6] ..... G10C 3/12

[52] U.S. Cl. ..... 84/435; 84/433; 84/251

[58] Field of Search ..... 84/251, 423 R, 84/433, 434, 435

[56] References Cited

U.S. PATENT DOCUMENTS 4,604,937 8/1986 Kumano et al. ..... 84/435
4,846,041 7/1989 Kumano et al. ..... 84/435
5,090,290 2/1992 Kumano et al. ..... 84/434

FOREIGN PATENT DOCUMENTS 64-43400 3/1989 Japan .
2-75696 6/1990 Japan .
2-160291 6/1990 Japan .
2-167595 6/1990 Japan .

*Primary Examiner*—Cassandra C. Spyrou
*Attorney, Agent, or Firm*—Armstrong, Westerman, Hattori, McLeland & Naughton

[57] ABSTRACT

A mechanism for rotatably supporting a rotary member of a keyboard of an electronic piano or the like is made up of a bearing member and a holding member. The bearing member has a bearing portion which is made up of two plates. Each of the plates has a semicircular recessed portion which dents downwards and a groove on one side of the recessed portion. On the other side of the recessed portion, there is formed a mounting portion to hold the bearing member in position. The holding member is made by a plate. One end of the holding member is inserted into the grooves and the other end thereof is fixed to a keyboard chassis.

12 Claims, 7 Drawing Sheets

MECHANISM FOR ROTATABLY SUPPORTING ROTARY MEMBER OF KEYBOARD

BACKGROUND OF THE INVENTION

1. Field of the Invention

The present invention relates to a mechanism for rotatably supporting a rotary member of a keyboard such as, for instance, of an electronic piano or the like.

2. Description of Related Art

As a mechanism for rotatably supporting a key of an electronic musical instrument, there has hitherto been known, as shown in FIG. 18, one which is made up of a bearing member d and a key f. The bearing member d has a pair of wall plates "a", "a". Each of the wall plates has formed therein a hole b which laterally (i.e., perpendicularly to the longitudinal direction of the key) penetrates the wall plate "a", and a guide groove c which is formed in the wall plate "a" so as to be in communication with the hole b and also have an access from above. The key f is provided at one longitudinal end thereof with laterally extending rotary (or pivot) shafts e, e of oval cross section, one on each side wall thereof. The rotary shafts e, e of the key f are thus fitted into the holes b, b through the guide grooves c, c.

In the above-described conventional mechanism for rotatably supporting the key, the rotary shaft f of the key f has an oval cross section. Therefore, there is a disadvantage in that sufficient surfaces of contact between the rotary shafts e, e and the bearing members d, d cannot be obtained, with the result that the mechanical strength of the rotary shaft is low.

In view of the above-described disadvantage of the conventional art, the present invention has an object of providing a mechanism for rotatably supporting a rotary member of a keyboard, such as, of an electronic piano, or the like, in which the mechanical strength of a rotary shaft of a key, or the like, does not decrease.

SUMMARY OF THE INVENTION

In order to attain the above object, the present invention is a mechanism for rotatably supporting a rotary member of a keyboard of an electronic piano, or the like. The mechanism comprises: a bearing member in which is formed a semicircular recessed portion; and a holding member which holds that rotary shaft of a rotary member such as of a key, and a hammer to be rotated by depression of the key or the like, which is fitted into the recessed portion of the bearing member.

The above-described holding member is preferably made such that one end of the holding member is inserted into a groove formed on one side of the bearing member and that the other end of the holding member is fixed to the other side of the bearing member, the one side and the other side being positioned with the recessed portion in between.

As the holding member, the keyboard chassis on which a plurality of keys are mounted may be used. In this case, the bearing member, to which a rotary shaft of a rotary member, such as, a key, or the like, is fitted into the recessed portion is mounted on the keyboard chassis so that the rotary shaft may be held by the bearing member and the keyboard chassis.

In holding the rotary shaft, preferably, a groove formed on one side of the bearing member is fitted onto an edge portion of the keyboard chassis and the other side of the bearing member is fixed to the keyboard chassis.

The bearing member may be provided in a plurality of laterally disposed pieces which are connected to each other.

As the holding member, there may be used one which has a length to cover the plurality of bearing members.

Further, the holding member, preferably, is provided with a tape for adjusting a clattering. This tape is adhered to that side of the holding member, which faces the rotary shaft of the rotary member. The tape may be made of an elastic material or a material having a friction coefficient, which is sufficient to give the key a feeling of touching which is similar to that of an acoustic piano when the key is depressed or released from depression. The tape may also be of a two-layer construction made up of a first layer of an elastic material and a second layer having a high wear resistance.

The holding member may have an engaging portion, for engaging one end of a spring, the other end of which is engaged with the rotary member.

According to the present invention, the rotary shaft of the rotary member, such as, the hammer, the key, or the like, is supported by the bearing member, having the semicircular recessed portion, for fitting the rotary shaft therein and the holding member, within the recessed portion having a larger surface of contact than that of the conventional one. If one end of the holding member is inserted into the groove, which is formed on one side of the bearing member, and the other end of the holding member is fixed to the other side of the bearing member, the one side and the other side being positioned with a recessed portion in between, the above-described one end of the holding member can be attached to or mounted on the bearing member without using fixing parts such as screws, bolts, or the like. If the bearing member, into the recessed portion of which is fitted the rotary shaft of the rotary member, such as the key, or the like, is mounted on the keyboard chassis, the rotary shaft can be held by the bearing member and the keyboard chassis without using a separate holding member. In this case, if the groove formed on one side of the bearing member is fixed to the edge portion of the keyboard chassis and the other side of the bearing member is fixed to the keyboard chassis, the one side and the other side being positioned with a recessed portion in between, the above-described one side of the bearing member can be mounted to the keyboard chassis without using fixing members such as screws, bolts or the like.

If the bearing member is provided by connecting a plurality of longitudinally disposed pieces to each other, and the holding member is provided in a length to cover a plurality of bearing members, the rotary shafts of the plurality of rotary members can be assembled to the bearing members at a smaller number of man-hours.

If the tape, for adjusting the clattering, is adhered to that side of the holding member which faces the rotary shaft of the rotary member, the clattering, if any, can be eliminated by this tape and the rotary member can be rotated smoothly. If a tape made of an elastic material is used as this tape, the clattering can be effectively removed without adjusting the thickness of the tape, even if there does exists a dispersion in the size or magnitude of the clattering or rattling. Further, if the tape is made of a material having a friction coefficient which is sufficient to give the key a feeling of touching, which is similar to that of an acoustic piano, when the key is depressed, or released from depression, there can be obtained, at the time of depressing and releasing the key, a feeling of key touching similar to the key touching characteristics of an acoustic piano. The rotary member can also be rotated smoothly. Further, if the tape of two-layer construction, made up of a first layer of an elastic material and a second layer having a high wear resistance, is used, there is a dual function of improving the wear resistance of the rotary shaft and of preventing the clattering between the rotary shaft and the bearing member.

If the holding member has an engaging portion for engaging one end of a spring, the other end thereof being engaged with the rotary member, a separate engaging member needs not be provided and the construction becomes simpler.

Preferably, the rotary shaft has that rib on the rotary shaft which is received in the recessed portion as well as flanges on both ends thereof so disposed as to be in contact with outer side walls of the holding member.

Preferably, the bearing member has an elastic claw means provided on a side which is opposite to the side provided with the groove. The claw means are so arranged as to be elastically engaged into an edge of a hole formed in a keyboard chassis to hold the bearing member in position.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Embodying examples of the present invention will now be explained in detail with reference to the accompanying drawings.

Figure 1:
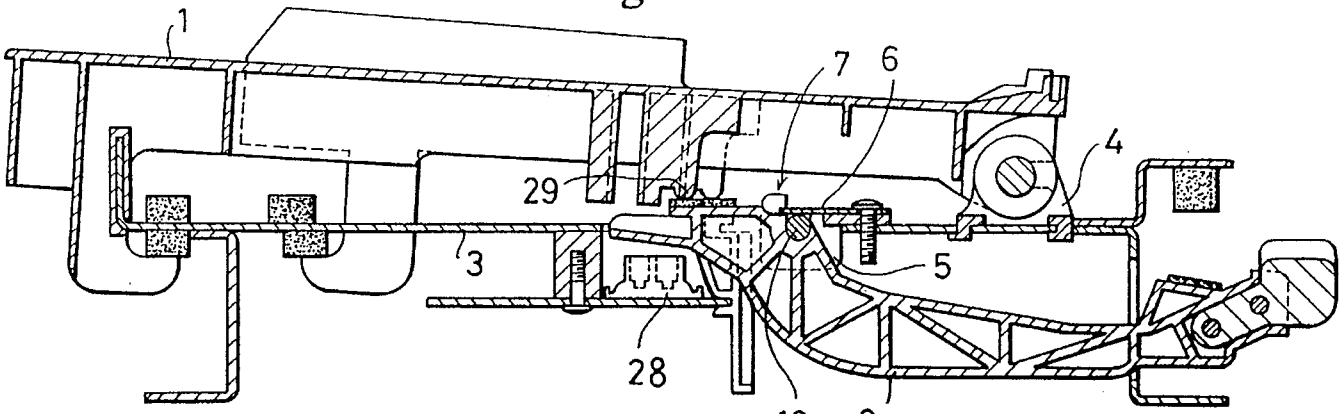
FIG. 1 is a side view, partly shown in section, of an electronic piano using the mechanism for rotatably supporting a rotary member according to the present invention.

In FIG. 1, numeral 1 denotes a key (white key) of an electronic piano and numeral 2 denotes a hammer which rotates as a result of the depression of the key 1 and which gives the key 1 an inertia mass.

Figure 2:
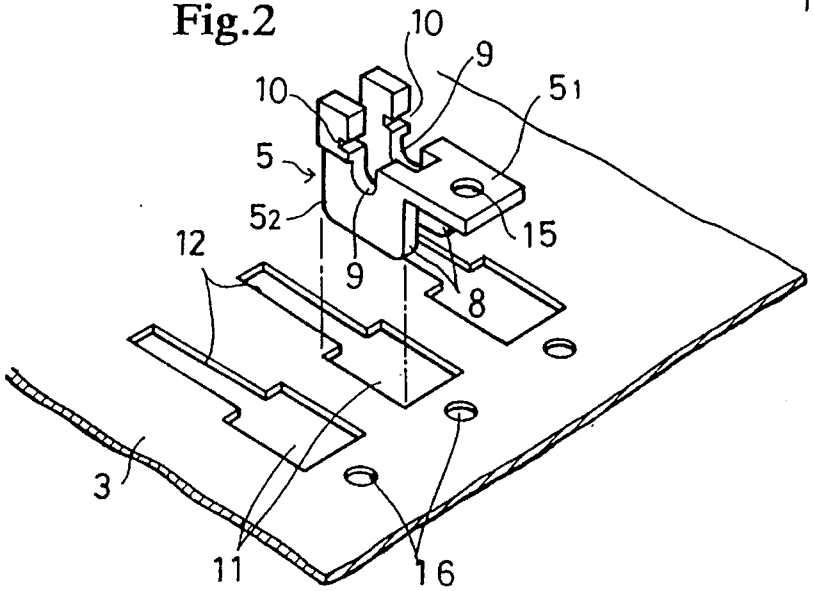
FIG. 2 is a perspective view of an important portion of the mechanism for rotatably supporting the rotary member shown in FIG. 1.
Figure 3:
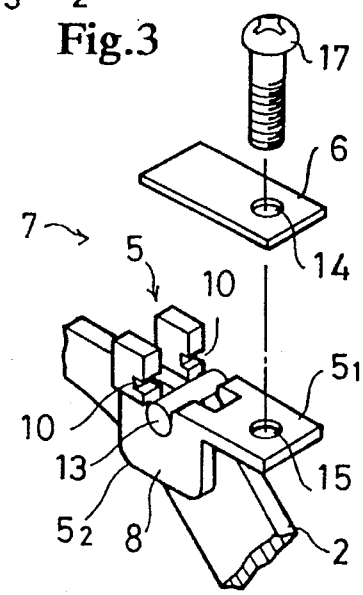
FIG. 3 is an exploded perspective view of the mechanism for rotatably supporting the rotary member with a hammer shown in FIG. 1 being rotatably supported thereby.

The key 1 is rotatably supported by fitting a dented portion, formed on a base end (i.e., an end opposite to the end to be depressed by the player) of the key 1 into a shaft portion 4 provided on a keyboard chassis 3. The hammer 2 is rotatably supported, as shown in FIGS. 2 and 3, by a mechanism 7 for rotatably supporting a rotary member which is made up of a bearing member 5 made, for example, of a synthetic resin and a plate-like holding member 6 made of steel or formed by resin forming. The bearing member 5 is made up of a mounting (or attaching) portion $5_1$ for mounting it on the keyboard chassis 3 and a bearing portion 52. The bearing portion 52 is made up of two plate members 8, 8. In each of the plate members 8, 8 there are formed a semicircular recessed portion 9 which dents downwards and a groove 10 which extends laterally (i.e., at right angles to the longitudinal direction of the key 1). On the other hand, in the keyboard chassis 3 there are formed, in a position corresponding to each of a plurality of keys 1, a hole 11 for fitting therein the bearing member 5 as well as that hole 12 for inserting thereinto the hammer 2 which is in communication with the above-described hole 11. The hammer 2 is inserted into the space between the two plate members 8, 8 of the bearing member 5 which is inserted into the hole 11 in the keyboard chassis 3 and engaged therewith. A rotary (or pivot) shaft 13 is fitted into the semicircular recessed portions 9, 9. One end of the holding member 6 is inserted into the grooves 10, 10 and the other end thereof is mounted to the keyboard chassis 3 by screwing a bolt 17 into a hole 16 in the keyboard chassis 3 through a hole 15 in the bearing member 5 and a hole 14 which is formed in the holding member 6.

By employing the above-described construction, i.e., by forming the grooves 10 in the bearing member 5 and by inserting the holding member 6 thereinto, the mechanical strength in the mechanism for rotatably supporting the rotary member can largely be improved. The hammer 2 will not vibrate at the time of depressing the key and, as a consequence, the feeling at the time of touching the key can be improved and the noises are reduced.

Figure 4A:
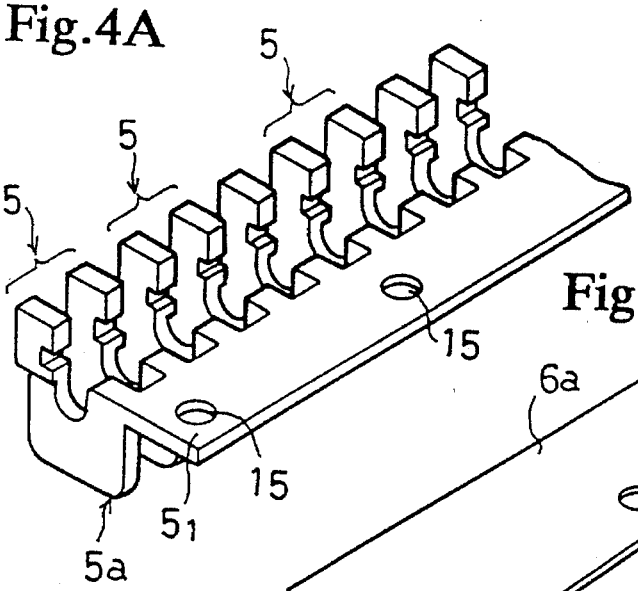
FIGS. 4A and 4B are perspective views of a modified example of a bearing member and a holding member.
Figure 4B:
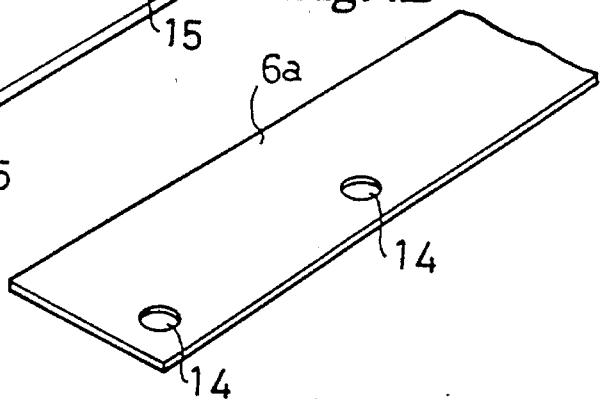

FIGS. 4A and 4B show another example of the present invention. In FIG. 4A a plurality of bearing members 5, which are disposed in the lateral direction, are integrally connected together at the mounting portion $5_1$ (as shown by 5*a*). FIG. 4B shows a holding member 6*a* to be used in connection with the above-described plurality of bearing members 5. The bearing member 5*a* and the holding member 6*a* shown respectively in FIGS. 4A and 4B are fixed to the keyboard chassis 3 by means of bolts, or the like, to be inserted through the holes 15 and 14 which are formed at every other position of the bearing members 5 and the holding members 6.

Figure 5A:
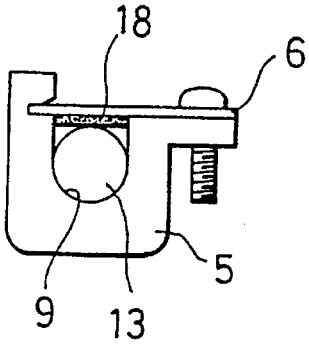
FIG. 5A is a side view of the mechanism for rotatably supporting the rotary member provided with a member for adjusting the clattering.
Figure 5B:
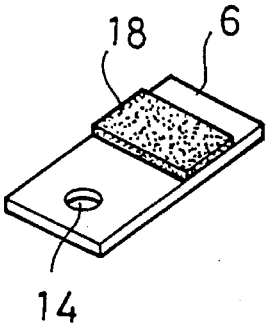
FIG. 5B is a perspective view of the holding member shown in FIG. 5A.

FIGS. 5A and 5B show an example in which a tape for adjusting (or preventing) the clattering (or rattling) of the key, when in motion, is adhered to the lower surface of the holding member 6.

This tape 18 is made of a resinous tape of polytetrafluoroethylene (known as "Teflon") or polyethylene, or else of a leather or the like. When the manufacturing accuracy of the rotary shaft 13 and the bearing member 5 is poor and there occurs a clattering therebetween, the tape can be applied by varying thicknesses to thereby prevent the occurrence of clattering. If a tape made of an elastic material such as felt, rubber or the like is used, the clattering can be prevented without varying the thickness thereof even if there may be some dispersion in the manufacturing accuracy. Further, if the friction between the rotary shaft 13 and the holding member 6 is adjusted by employing a tape 18 of large friction coefficient such as a polyethylene resin tape or the like, it is possible to obtain a feeling of touching the key like that of an acoustic piano. In other words, it is possible to obtain key stroke-load characteristics and, at the same time, to eliminate the clattering. Further, if a tape 18 of small friction coefficient with high wear resistance, such as, of polytetrafluoroethylene resin, or the like, is used, the wear of the rotary shaft 13 can be reduced. Still furthermore, if a tape of two-layer construction which is made up by adhering a tape of small friction coefficient on top of an elastic material is used as the tape 18, not only can the wear of the rotary shaft 13 be reduced but also can the clattering of the rotary shaft 13 be eliminated without the need for adjusting the thickness of the tape.

Figure 6A:
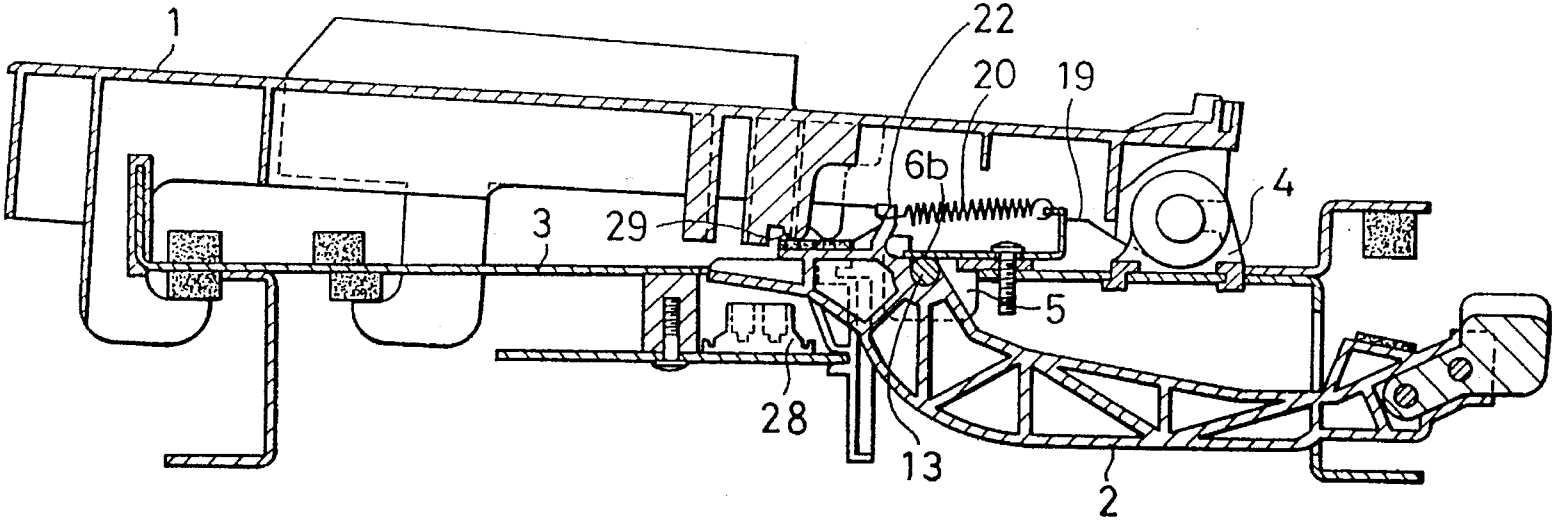
FIG. 6A is a side view, partly shown in section, of an electronic piano using the mechanism for rotatably supporting a rotary member according to one example of the present invention.
Figure 6B:
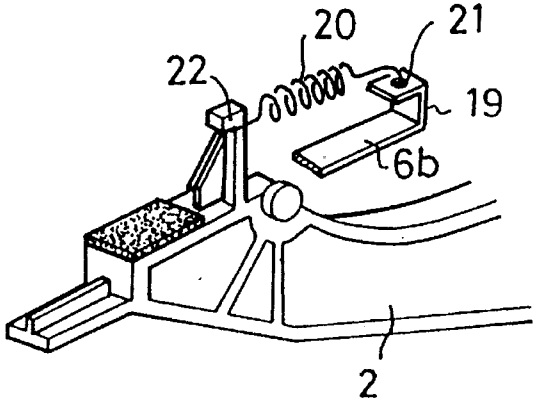
FIG. 6B is a perspective view of an important portion of the mechanism for rotatably supporting the rotary member shown in FIG. 6A.

FIGS. 6A and 6B show another example of the mechanism for rotatably supporting the hammer shaft by using a holding member 6*b* having an engaging portion 19 for engaging one end of a spring 20 which urges or biases the hammer 2. In this holding member 6*b*, there is integrally formed an engaging portion 19 on the opposite end (i.e., an end away from the bearing member), where a hole 21 for engaging one end of the spring 20 is formed. The opposite end of the spring 20 is engaged with an engaging projection 22 on the hammer 2. This hammer 2 is to obtain the feeling of touching the key like that of the acoustic piano by operating or causing to function the elastic force of the spring 20 on the key at the time of depressing the key or of releasing the key.

Figure 7:
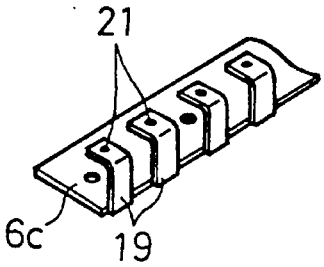
FIG. 7 is a modified example of the holding member.

FIG. 7 shows a holding member 6*c* which has a length extending to cover a plurality of bearing members 5. At that end position of the holding member 6*c* which corresponds to each of the keys 1, there are provided engaging members 19 which are similar to those as shown in FIG. 6.

Figure 8A:
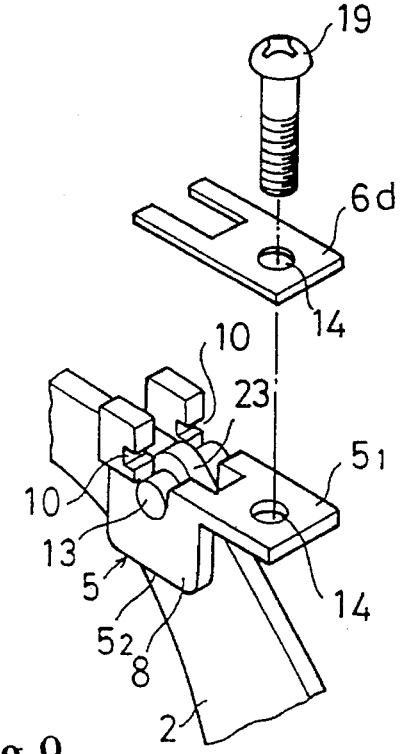
FIG. 8A is an exploded perspective view of the mechanism for rotatably supporting the rotary member of the present invention as applied to a modified example of the shaft of the hammer.
Figure 8B:
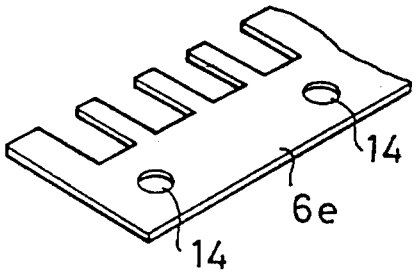
FIG. 8B is a perspective view of a modified example of the holding member to be used in the mechanism shown in FIG. 8A.

The rotary shaft 13 of the hammer 2 as shown in FIG. 8A has a rib 23 that can be inserted into the clearance between the plates 8, 8 of the bearing member 5. According to this construction, rigidity of the hammer 2 can be increased. With this bearing member 5 the holding members 6*d*, 6*e* as shown in FIGS. 8A or 8B are used.

Figure 9:
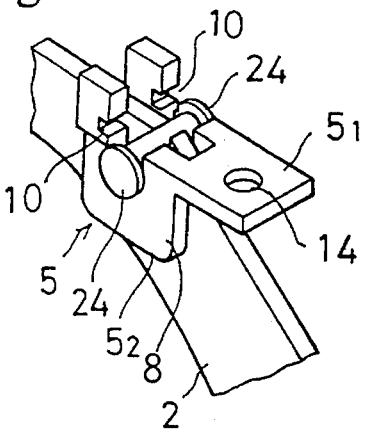
FIG. 9 is a perspective view of an important portion of the mechanism for rotatably supporting the rotary member according to the present invention as applied to a modified example of the rotary shaft of the hammer.

The hammer 2, shown in FIG. 9, has guide flanges 24, 24 on both sides of the rotary shaft 13. According to this arrangement, the flanges 24, 24 come into engagement with the external sides of the plate members 8, 8 of the bearing member 5. As a result, the lateral clattering of the hammer 2 can be prevented.

Figure 10:
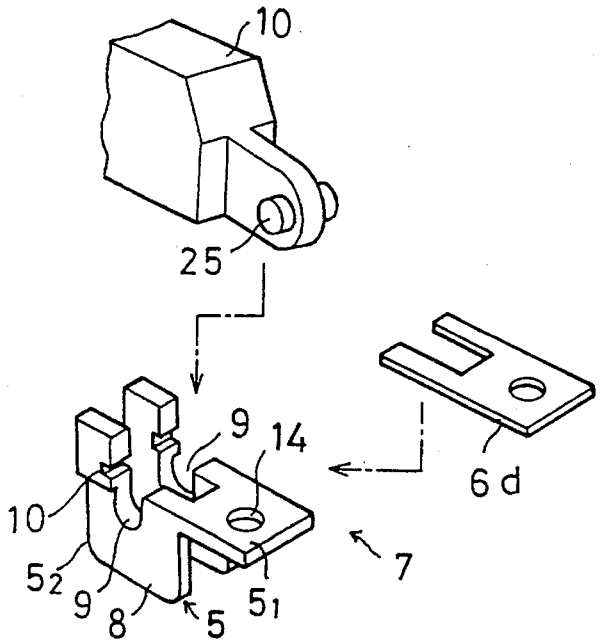
FIG. 10 is an exploded perspective view of the mechanism for rotatably supporting the rotary member according to the present invention as applied to the key.

The above-described mechanisms 7, for rotatably supporting the rotary member are employed with respect to the rotary shaft 13 of the hammer 2. It can, of course, be applied also to the rotary shaft 25 of the key 1 as shown in FIGS. 10 and 11.

Figure 11:
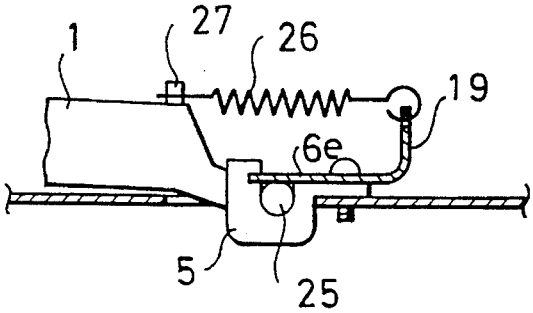
FIG. 11 is a side view, partly shown in section, of the mechanism for rotatably supporting the rotary member using another example of the holding member.

The holding member 6e shown in FIG. 11 is one in which the holding member 6e is provided with an engaging portion 19 for engaging one end of a spring 26 for returning the key 1. The other end of the spring 26 is engaged with an engaging projection 27 of the key 1.

In FIGS. 1 through 6A, numeral 28 denotes a switch which is operated by the rotation of the hammer 2 and numeral 29 denotes a projection for rotating the hammer 2 when the key 1 is depressed.

Figure 12A:
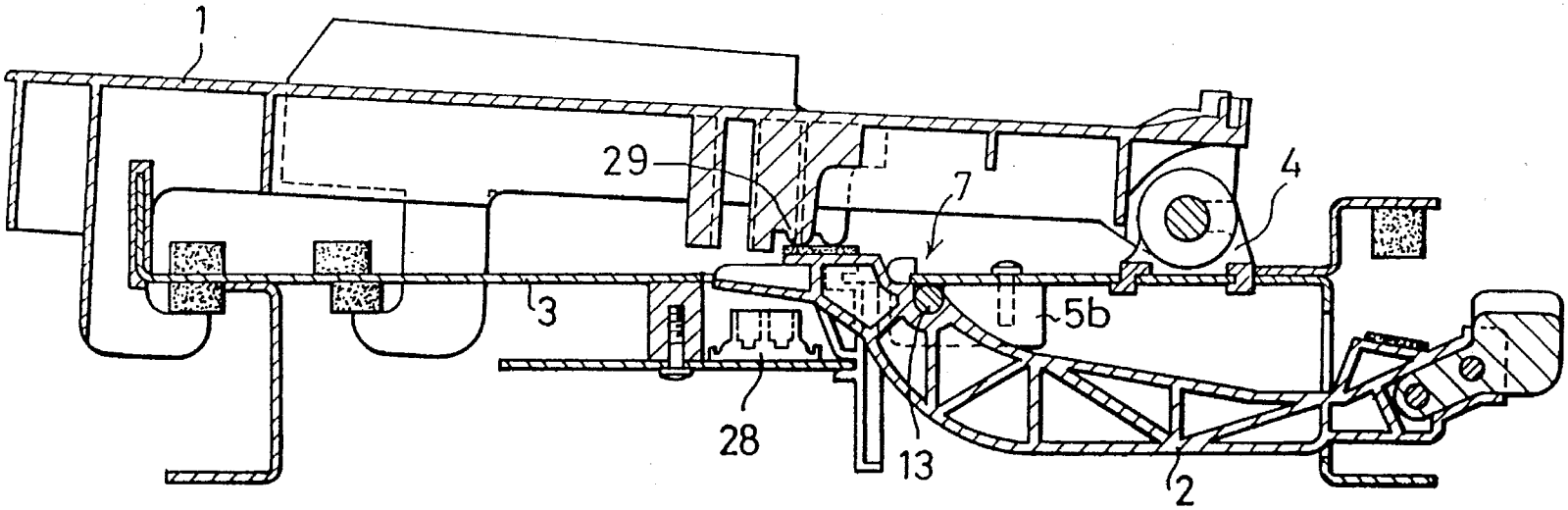
FIG. 12A is a side view, partly in section, of an important portion thereof.
Figure 12B:
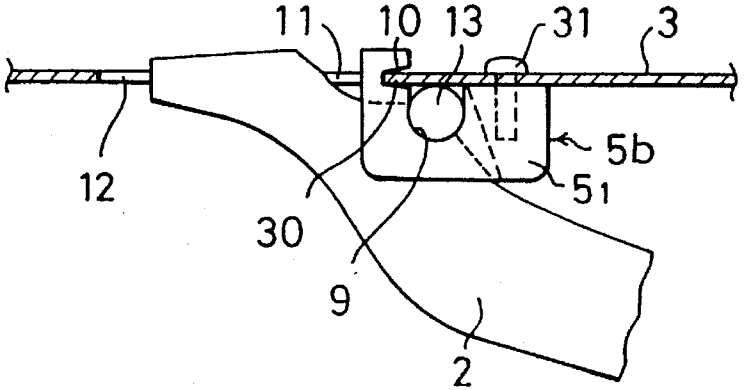
FIG. 12 is a side view, partly shown in section, of an electronic piano using another example of the mechanism for rotatably supporting the rotary member according to the present invention.

FIGS. 12A and 12B show still another example of the mechanism for rotatably supporting the rotary member according to the present invention.

The key 1 is rotatably supported, like in the one shown in FIG. 1, by fitting a dented portion, formed in the base end thereof, into the shaft portion 4 which is provided on the keyboard chassis 3. The hammer 2 is rotatably supported by a mechanism 7 for rotatably supporting a rotary member which is made up of a keyboard chassis 3 and a bearing member 5 which is fixed thereto.

Figure 13:
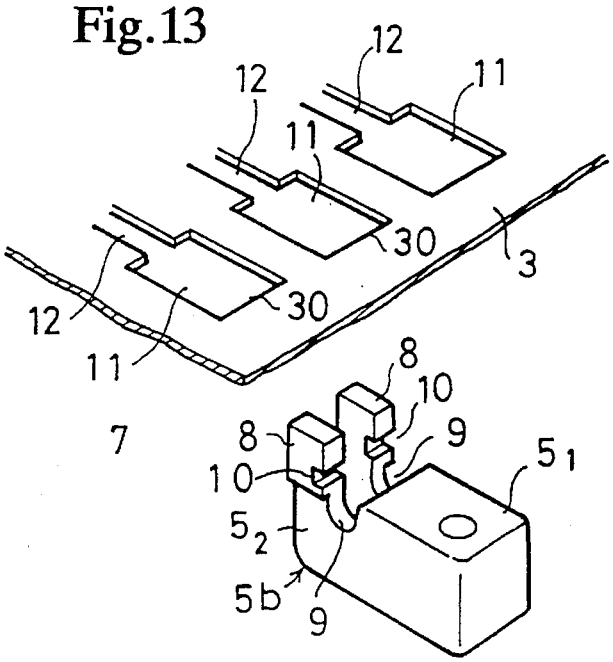
FIG. 13 is an exploded perspective view of a mechanism for rotatably supporting the rotary member shown in FIG. 12.

The mechanism 7, for rotatably supporting a rotary member, will now be explained in more detail. As shown in FIG. 13, the bearing member 5*b* is made up of a mounting portion $5_1$ for mounting it to the keyboard chassis 3 and a bearing portion 52. The bearing portion $5_2$ is made up of two plates 8, 8. In each of the plates 8, 8 there is formed a semicircular recessed portion 9 which extends downwards and a groove 10 which extends laterally (i.e., at right angles to the longitudinal direction of the key 1). On the other hand, in the keyboard chassis 3 there are formed, in a position corresponding to each of a plurality of keys 1, an a hole 11 for fitting therein the bearing member 5*b*, as well as that hole 12 for inserting thereinto the hammer 2 which is in communication with the above-described hole 11. As shown in FIGS. 12A, 12B, the hammer 2 is inserted into the space between the two plate members 8, 8 and the rotary shaft 13 is fitted into the semicircular recessed portions 9, 9 to thereby support the hammer 2. Thereafter, the grooves 10, 10, on one side of the bearing member 5*b*, are fitted into a fringe or edge 30 of the hole 11 of the keyboard chassis 3 and the mounting portion $5_1$ which is positioned on the other side, as seen from the side provided with the grooves 10, 10, of the recessed portions 9, 9 is fixed to the keyboard chassis 3 by means of a bolt 31 to thereby hold the rotary shaft 13 with the keyboard chassis 3.

Figure 14A:
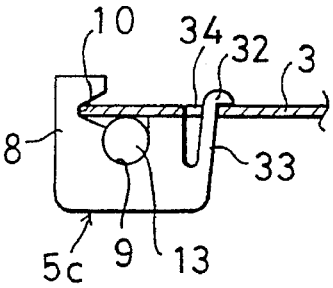
FIG. 14A is a side view of another example of the mechanism for rotatably supporting the rotary member shown in FIG. 13.
Figure 14B:
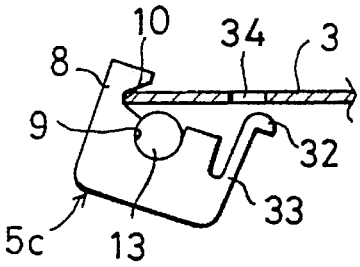
FIG. 14B is a side view showing the above in the process of assembling.

As show in FIGS. 14A and 14B, the bearing member 5*c* may be of a construction in which an elastic member 33 having a claw portion 32 at an end thereof is integrally formed on the above-described other side of the recessed portions 9, 9. According to this arrangement, the elastic member 33 is inserted into a hole 34 in the keyboard chassis 3 to thereby fix by engaging the claw portion 32 with the fringe of the hole 34. Therefore, fixing bolts can be eliminated.

Figure 15:
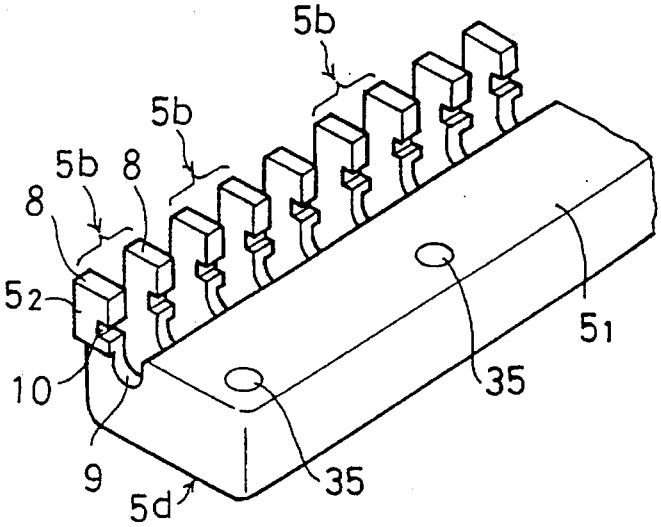
FIG. 15 perspective view of a modified example of the holding member shown in FIG. 13.

FIG. 15 is an example in which a plurality of laterally disposed bearing members 5*b* are connected together at the mounting portion $5_1$ (as shown by 5*d*). This bearing member 5*d* is fixed to the keyboard chassis 3 by inserting fixing bolts through holes 35 formed at every other position of the bearing members 5*b*.

Figure 16:
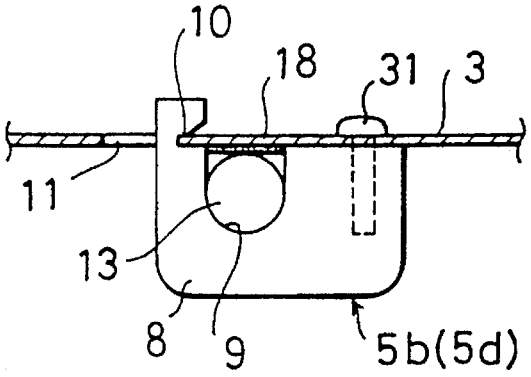
FIG. 16 is a side view, partly shown in section, of the mechanism for rotatably supporting the rotary member using a member for adjusting the clattering shown in Figs. 13 and 15.

FIG. 16 is an example in which a tape 18, for adjusting the clattering, or rattling, is adhered to that position below the keyboard chassis 3 which faces or opposes the rotary shaft 13.

As the tape 18 for adjusting the clattering, there may be used one that is the same as that shown in FIG. 5. The tape 18 may be disposed separately in a number corresponding to the plurality of bearing members 5*b* or common tapes may be disposed so as to cover an arbitrary plural number of keys, or a single piece of tape may be used to cover the entire keys.

In the mechanism 7 for rotatably supporting the rotary member, as shown in FIGS. 12A through 16, the rib 23 of the rotary shaft 13 of the hammer 2 can be inserted into the space between the plate members 8, 8 of the bearing members 5*b*, 5*c*, 5*d* as shown in FIGS. 8A, 8B and 9. Further, by causing the two guide flanges 24, 24, which are provided on both sides of the rotary shaft 12 of the hammer 2, to contact the outside of the plate members 8, 8, the same effect can be obtained as the one shown in FIGS. 8 and 9.

Figure 17:
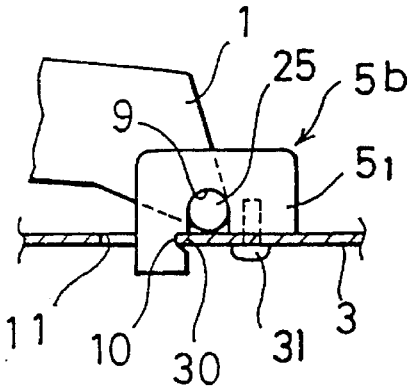
FIG. 17 is a side view, partly shown in section, of the mechanism for rotatably supporting the rotary member as applied to the supporting of the key.
Figure 18:
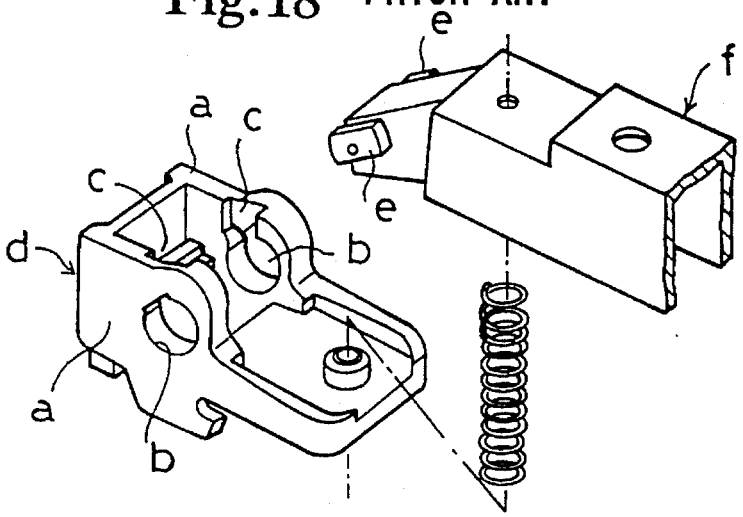
Fig.18 PRIOR ART
FIG. 18 in exploded perspective view of a conventional mechanism for rotatably supporting a rotary member.

FIG. 17 shows another example in which the above-described mechanism, for rotatably supporting a rotary member, is applied to the rotary shaft 25 of the key 1. After the rotary shaft 25, of the key 1, has been fitted into the recessed portion 9 of the bearing member 5*b*, they are placed on the keyboard chassis 3 and the grooves 10 are fitted into the fringe 30 of the keyboard chassis 3. The mounting portion $5_1$ on the other side of the grooves 10 is fixed to the keyboard chassis 3 by means of a screw 31.

As described hereinabove, according to the various aspects of the above-described arrangements of the present invention, there are the following effects. Namely, the mechanical strength of the hammer or of the key is improved and the rotatably supporting construction becomes simple. The number of constituent parts can be reduced. Clattering does not occur even if there is an error in dimensions in the rotary members and the rotary shafts. The feeling of touching the key can be made similar to that of an acoustic piano.

It is readily apparent that the above-described mechanism for rotatably supporting a rotary member meets all of the objects mentioned above and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A mechanism for rotatably supporting a rotary member of a keyboard of an electronic piano, said mechanism comprising:

a bearing member in which is formed a semicircular recessed portion;

a holding member for holding a rotary shaft of a rotary member, said rotary shaft being fitted into said recessed portion of said bearing member, wherein one end of said holding member is inserted into a groove formed on one side of said bearing member and wherein the other end of said holding member is fixed to the other side of said bearing member, said one side and said other side being positioned with said recessed portion in between.

2. A mechanism for rotatably supporting a rotary member of a keyboard of an electronic piano, said mechanism comprising:

a bearing member in which is formed a semicircular recessed portion;

a holding member for holding a rotary shaft of a rotary member, said rotary shaft being fitted into said recessed portion of said bearing member, wherein said holding member is made up of a keyboard chassis on which a plurality of keys are mounted and wherein said bearing member to which a rotary shaft of a rotary member is fitted into said recessed portion is mounted on said keyboard chassis, whereby said rotary shaft is held by said bearing member and said keyboard chassis.

3. A mechanism for rotatably supporting a rotary member according to claim 2 wherein a groove formed on one side of said bearing member is fitted onto an edge portion of said keyboard chassis and wherein the other side of said bearing member is fixed to said keyboard chassis, said one side and said the other side being positioned with said recessed portion in between.

4. A mechanism for rotatably supporting a rotary member according to any one of claims 1 through 3, wherein said bearing member is provided in a plurality of laterally disposed pieces which are connected to each other.

5. A mechanism for rotatably supporting a rotary member according to claim 4, wherein said holding member has a length to cover a plurality of bearing members.

6. A mechanism for rotatably supporting a rotary member according to claim 1 wherein said bearing member has an elastic claw means provided on a side which is opposite to the side provided with said groove, said claw means being so arranged as to be elastically engaged into an edge of a hole formed in a keyboard chassis to hold said bearing member in position.

7. A mechanism for rotatably supporting a rotary member of a keyboard of an electronic piano, said mechanism comprising:

a bearing member in which is formed a semicircular recessed portion;

a holding member for holding a rotary shaft of a rotary member, said rotary shaft being fitted into said recessed portion of said bearing member further comprising a tape for adjusting a clattering, said tape being adhered to that side of the holding member which faces the rotary shaft of said rotary member.

8. A mechanism for rotatably supporting a rotary member according to claim 7, wherein said tape has an elasticity.

9. A mechanism for rotatably supporting a rotary member according to claim 7, wherein said tape is made of a material having a friction coefficient which is sufficient to give the key a feeling of touching which is similar to that of an acoustic piano when the key is depressed or released from depression.

10. A mechanism for rotatably supporting a rotary member according to claim 7, wherein said tape is of a two-layer construction made up of a first layer of an elastic material and a second layer having a high wear resistance.

11. A mechanism for rotatably supporting a rotary member of a keyboard of an electronic of a said mechanism comprising:

a bearing member in which is formed a semicircular recessed portion;

a holding member for holding a rotary shaft of a rotary member, said rotary shaft being fitted into said recessed portion of said bearing member, wherein said holding member has an engaging portion for engaging one end of a spring the other end of which is engaged with said rotary member.

12. A mechanism for rotatably supporting a rotary member of a keyboard of an electronic piano, said mechanism comprising:

a bearing member in which is formed a semicircular recessed portion;

said bearing member holding a rotary shaft of a rotary member, said rotary shaft being fitted into said recessed portion of said bearing member wherein said rotary shaft has flanges on both ends thereof so disposed as to be in contact with outer side walls of said bearing member.

* * * * *